United States Patent [19]

Brauer

[11] 4,308,740

[45] Jan. 5, 1982

[54] ROLLING LINES FOR THE ROLLING OF WIRE OR RODS

[75] Inventor: Hans Brauer, Leichlingen, Fed. Rep. of Germany

[73] Assignee: Kocks Technik GmbH & Co., Dusseldorf, Fed. Rep. of Germany

[21] Appl. No.: 110,249

[22] Filed: Jan. 7, 1980

[30] Foreign Application Priority Data

Jan. 29, 1979 [DE] Fed. Rep. of Germany ..... 2903358

[51] Int. Cl.[3] ..... B21B 1/18; B21B 27/00

[52] U.S. Cl. ..... 72/234; 72/236

[58] Field of Search ..... 72/234, 235, 199, 238, 72/236, 366, 224, 226

[56] References Cited

U.S. PATENT DOCUMENTS

| | | | |
|---|---|---|---|
| 3,197,993 | 8/1965 | Hein et al. | 72/230 |
| 3,722,250 | 3/1973 | Demny | 72/224 |
| 3,726,119 | 4/1973 | Bindernagel | 72/234 |
| 3,930,395 | 1/1976 | Breilschneider et al. | 72/228 |

*Primary Examiner*—Milton S. Mehr

*Attorney, Agent, or Firm*—Buell, Blenko, Ziesenheim & Beck

[57] ABSTRACT

In the rolling of wire or rod in a rolling line having a roughing or intermediate block whose rolling stands have non-adjustable rolls except for those at the exit end of the block, the rolls of the non-adjustable stands can be re-used at least once in the same stand location after being re-conditioned by reconditioning all the rolls defining a first series of sizing passes so as to form a second series of sizing passes whose individual sizes are larger than those of the first series. The change in dimensions of a given sizing pass as a result of reconditioning is less than the difference between the dimensions of that sizing pass after reconditioning (i.e. of the second series ) and the dimensions of the immediately preceding sizing pass before reconditioning (i.e. of the first series). Thus, after a second or subsequent reconditioning the rolls of a given stand are transferred to the immediately preceding stand for re-use to define the first series of sizing passes.

In this way, the amount of roll material removed at each reconditioning operation is reduced.

3 Claims, 2 Drawing Figures

ROLLING LINES FOR THE ROLLING OF WIRE OR RODS

DESCRIPTION

The invention relates to the operation of a rolling line for the rolling of wire or rods, having at least one roughing and/or intermediate block which has, at its entry end, a plurality of rolling stands whose sizing passes are formed by non-adjustable rolls, and which has, at its exit end, two or more individually and controllably driven rolling stands having radially adjustable rolls.

In a known rolling line of this kind, the sizing passes are each formed by three rolls which have cylindrical working faces and which are angularly offset through 120 degrees in a star-like manner about the run-through axis of the work-material. Particularly favourable efficiency of deformation is obtained and in particular a high elongation with a small amount of broadening is achieved by means of rolling stands of this kind, and with careful treatment of the work-material. However, in rolling stands whose sizing passes comprise three or more rolls, it is a relatively expensive matter to construct the rolls so as to be radially adjustable. Therefore, in order to economise on capital expenditure, most rolling stands are constructed with non-adjustable rollers, particularly in the case of the roughing- and/or intermediate blocks of a rolling line, and only a few, usually only two, of the rolling stands disposed at the exit end of each rolling block, are provided with radially adjustable rolls. These rolling stands serve to produce differing cross sections of the work material, so that each of the rolling blocks, arranged one behind the other, of the rolling line produces, as far as possible, work-material having a cross section which corresponds accurately to the predetermined cross section.

In the known rolling lines of the type mentioned initially, only a single series of sizing passes is used in the roughing- and/or intermediate blocks for a specific rolling programme. By way of example, when work-material having uniform cross-sectional areas is rolled for a long period of time, the working surfaces of the rolls wear and the rolls have to be re-conditioned. Since the rolls of most rolling stands of the roughing- and/or intermediate blocks are not adjustable, it has hitherto been the practice to recondition the rolls of each stand to suit the immediately preceding sizing pass. However, the difference between the sizing passes of two adjacent rolling stands is relatively great, particularly in roughing- and/or intermediate blocks, so that the rolls require a considerable amount of re-conditioning to render the sizing pass, thus produced, suitable for the immediately preceding rolling stand. In particular, the quantity of expensive material which has to be removed from the rolls by machining is considerably more than is required simply to remove the grooves produced by natural wear. Consequently, the expensive material of the rolls cannot be utilised to an optimum extent.

An object of the invention is to provide a rolling line of the kind described initially in which the rolls, particularly of the roughing- and/or intermediate blocks, can be utilised to an optimum extent.

The invention consists in a method of operating a rolling line for the rolling of wire or rods, having at least one roughing- and/or intermediate block which has, at its entry end, a plurality of rolling stands whose sizing passes are formed by non-adjustable rolls, and which has, at its exit end, two or more individually and controllably driven rolling stands having radially adjustable rolls, in which method, for the purpose of rolling uniform cross sections of the work-material at least two different series of sizing passes are used successively in those rolling stands of the roughing- and/or intermediate block which have non-adjustable rolls, the diameters of the notional circles, inscribed in the sizing passes of the second and/or further series of sizing passes in each cone being smaller than that of the notional inscribed circle of that sizing pass of the first series of sizing passes which is adjacent to the corresponding sizing pass and disposed at the entry side thereof the gradation of the notational inscribed circle diameter of a sizing pass of the first series to that of the corresponding sizing pass of the second series being at least approximately the same as the gradation from the corresponding sizing pass of the second or last series to that sizing pass at the entry side of the corresponding sizing pass of the first series.

Thus, in accordance with the invention, the worn rolls defining the sizing passes of the first series are reconditioned to an intermediate size, whereupon they can be re-used to define the sizing passes at the same stand locations to form the second series. It is only when they are worn for a second or even third time, and have to be re-conditioned, that the sizing passes defined thereby become so large that the rolls have to be used at one stand location nearer to the entry end of the block in each case, as was customary with the known constructions after the first re-conditioning operation. This results in an advantageous saving of roll material, and the total useful life of the rolls is at least doubled.

However, the total useful life of the rolls can be tripled or quadrupled, namely in cases in which particularly large differences exist between the adjacent sizing passes, which is frequently the case, particularly in the roughing blocks. The rolls are then not only re-conditioned to one intermediate size, but are successively re-conditioned to a plurality of intermediate sizes, and are thus re-conditioned several times, and are used several times at the same stand location before their sizing pass has become so large that it is only possible to use them at the adjacent stand location towards the entry end. Thus, the invention can also be used with three or more different series of sizing passes. Advantageously, the rolls are even better utilised than in the case of just two different series of sizing passes, and less roll material is removed during each reconditioning operation.

The operation of a rolling line in accordance with the invention also results in a considerable saving of time and expense for the reconditioning operation, since only a small amount of material has to be removed. The first stand at the entry end of the block is provided with a sizing pass which corresponds to the first pass entry cross-sectional area of the incoming starting material. Each row of sizing passes is thereby dimensioned such that the gradation between the first and the second sizing passes is not disproportionately larger than that between the other sizing passes and substantially corresponds to the gradation between the second and third sizing passes and, at the most, is only slightly larger.

Advantageously, for the purpose of rolling uniform cross sections of the work-material with a uniform first pass entry cross-sectional area of the starting material, but with different series of sizing passes, the rotational speeds of the rolls of the first rolling stand at the entry end are separately regulable, preferably by means of control mechanisms. This measure is advisable, since the reconditioning operation imparts somewhat larger sizing passes to, for example, the second series of sizing passes than those of the first series of sizing passes, so that, owing to the smaller reduction of the cross section resulting therefrom, and despite a uniform first pass entry cross-sectional area, work-material having a larger cross section enters the rolling stands which are disposed at the exit end of the block and which have adjustable rolls. Although this larger cross section can be reduced to the delivery cross section required (which is to be maintained) by corresponding adjustment of the rolls in the rolling stands at the exit end, it is only possible to reduce this cross section to a limited extent. In order to relieve the rolling stands which are disposed at the exit end and which have the adjustable rolls, a higher elongation can be obtained, and thus the cross section of the work material can be approximately maintained, by varying the speeds of the rolls of the first rolling stand at the entry end, although the second series of sizing passes has larger sizing passes. For this purpose, in a group drive for the non-adjustable rolling stands, a step change is sufficient between the drive for the first and second rolling stands. If it is desired to use several different series of sizing passes, the drive has to be equipped with two or more step changes in a corresponding manner.

In contrast to this, however, it is also possible for starting material having a suitable first pass entry cross-sectional area to enter for the purpose of rolling uniform cross sections of work-material at constant rotational speeds but with different series of sizing passes. This solution is advisable when work-material having various first pass entry cross-sectional areas is available. It is then unnecessary to provide an arrangement for varying the rotational speed of the first rolling stand at the entry end.

The invention is further described, by way of example, with reference to the drawings, in which.

Figure 1:
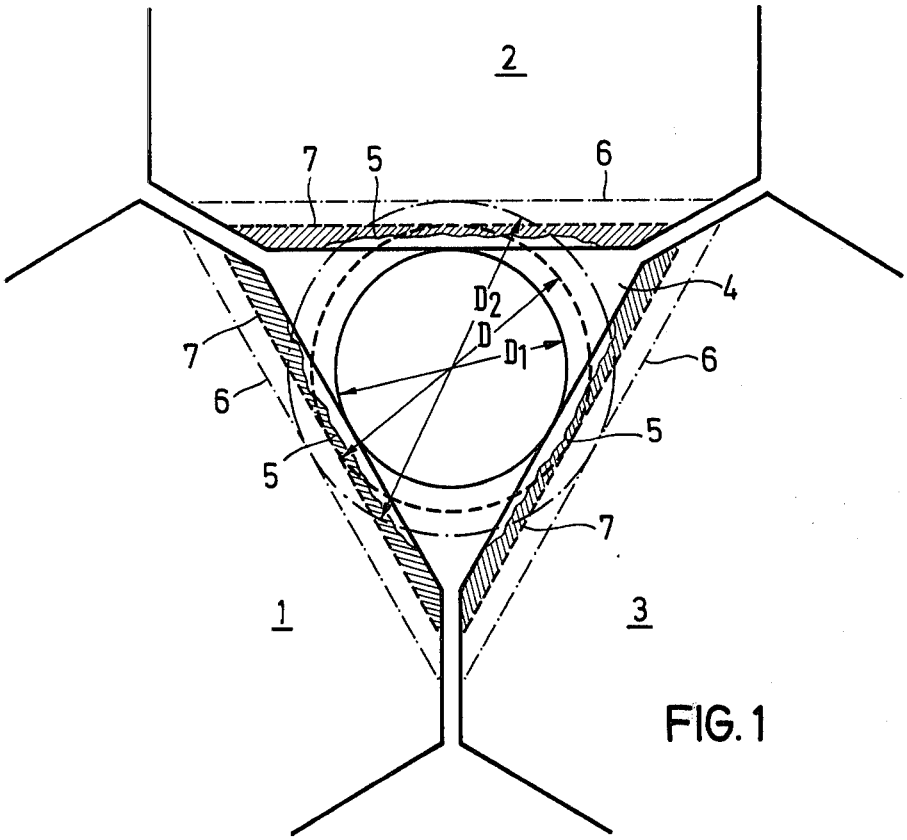
FIG. 1 shows a sizing pass viewed in the rolling direction.

Referring to FIG. 1, three rolls 1, 2 and 3 form a sizing pass 4. Only a small portion of each of the rolls 1, 2 and 3 is visible.

In new rolls 1, 2, 3 which form the first row of sizing passes, the sizing pass 4 is at a minimum and thus also the inscribed circle whose diameter is designated $D_1$. The inscribed circle is only a given dimension and does not correspond to the cross section of the work-material.

After a long time in operation, the rolls 1, 2 and 3 wear approximately in the manner as is shown by the lines designated 5. When the amount of wear is as great as this, work-material having an irregular surface is produced, and the rolls 1, 2 and 3 have to be re-ground. The conventional manner of doing this resided in grinding down the rolls 1, 2, 3 to the dash-dot lines 6, so that the diameter $D_2$ was imparted to the inscribed circle which is also shown by a dash-dot line. The sizing pass 4 thus produced was substantially larger and corresponded to the dimensions required at the adjacent stand location at the entry side where the rolls 1, 2 and 3 were also subsequently used. However, in accordance with the invention, only the portion shown by hatching is to be machined during reconditioning, so that the broken lines 7 represent the new working surfaces of the rolls 1, 2 and 3. This reconditioning is entirely sufficient to remove the wear phenomenon shown by the lines 5. One obtains an inscribed circle having the diameter D which is substantially smaller than that of the inscribed circle $D_2$ which the sizing pass would have if it had been reconditioned in a conventional manner. The consequently smaller sizing pass 4 can be reused at the same stand location, provided, of course, that all the other sizing passes of the non-adjustable rolling stands have been reconditioned in a corresponding manner.

Figure 2:
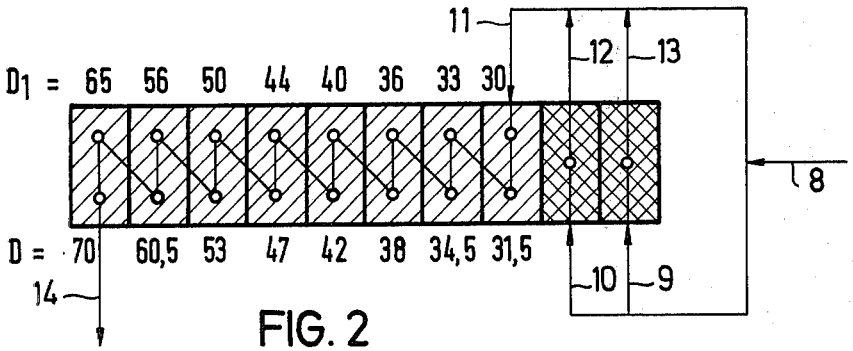
FIG. 2 is a diagram showing the method of using the rolls.

A roughing- or intermediate block having ten rolling stands is illustrated diagrammatically in FIG. 2. Eight of the ten rolling stands is equipped with non-adjustable rollers, this being shown by he simple hatching. The two rolling stands at the exit end are denoted by double cross-hatching have adjustable rolls and a separate regulatable drive. The arrow 8 shows where new rolls are fitted in the rolling block for the first time. This fitting can be effected at the two rolling stands at the delivery end and having the adjustable rolls, or, alternatively, the last of those rolling stands having non-adjustable rolls. This is shown by the arrows 9, 10 and 11. The arrows 12 and 13, together with the arrow 11, show that worn and reconditioned rolls from the adjustable rolling stands are fitted in the last rolling stand having non-adjustable rolls.

The given diameters $D_1$ of the inscribed circles of a first series of sizing pases which, for example, is provided, are shown above the rolling stands having non-adjustable rolls. The given diameters D of the second series of sizing passes, which is produced by reconditioning the rolls defining the first series of sizing passes, are given below these rolling stands. The small circles in the symbols of the rolling stands in each case represent the use of a roll, which shows that, in the example of FIG. 2, the dash-dot line 6 (shown in FIG. 1) having the inscribed diameter $D_2$ is reached after the second use of the rolls and after the second reconditioning operation, the diameter $D_2$ then corresponding to the inscribed circle, having the diameter $D_1$, of the adjacent rolling stand towards the entry end.

FIG. 2 thus shows that the rolls pass through the entire rolling block and are only used once in the adjustable rolling stands, while they are in each case used twice in the rolling stands having the non-adjustable rolls. When a roll has arrived in this manner in the first rolling stand at the entry end where it is also ground for the second time, it is finally removed, as is indicated by the arrow 14. It will be appreciated that a large number of other sizes of the rows of sizing passes is conceivable, and also more than two series of sizing passes for the same finished cross section of the work-material, if this is permitted by the magnitude of the graduation of the sizing passes between adjacent rolling sizing passes.

I claim:

1. A method of operating a rolling line for the rolling of wire or rods, having at least one roughing and/or intermediate block which has, at its entry end, a plurality of rolling stands whose sizing passes are formed by radially non-adjustable rolls, and which has, at its exit end, two or more individually and controllably driven rolling stands having radially adjustable rolls, comprising the steps of:

(a) passing a work material through at least two different series of sizing passes successively in those rolling stands of the roughing and/or intermediate block which have non-adjustable rolls, (b) providing rolls in each stand of substantially identical diameters and such that the diameters of a notional circle, inscribed in each of the sizing passes, of the second series of sizing passes in each stand being smaller than that of a notional inscribed circle of that sizing pass of the first series of sizing passes which is adjacent to and at the entry side thereof, (c) grinding each set of rolls when the surface of said rolls becomes unsatisfactory only a sufficient amount to provide a satisfactory roll surface while maintaining all rolls in each stand at substantially equal diameters, and (d) moving said rolls from one series to the other from time to time successively from the delivery end of the mill to the entry end of the mill as grinding of the rolls changes the notional inscribed circle diameter whereby to maintain a generally desired gradation of the notional inscribed circle diameter in successive stands from entry to delivery end.

2. A method of operating a rolling line as claimed in claim 1, in which the rotational speeds of the rolls of the first rolling stand at the entry end of the block are separately regulable for the purpose of rolling uniform cross sections of the work material with a uniform first pass entry cross-sectional area of the starting material but with different series of sizing passes.

3. A method of operating a rolling line as claimed in claim 1, in which starting material having an appropriate first pass entry cross-sectional area enters different series of sizing passes for the purpose of rolling uniform cross sections of work-material with constant rotational speeds.

* * * * *

UNITED STATES PATENT AND TRADEMARK OFFICE

CERTIFICATE OF CORRECTION

PATENT NO. : 4,308,740

DATED : January 5, 1982

INVENTOR(S) : HANS BRAUER

It is certified that error appears in the above-identified patent and that said Letters Patent are hereby corrected as shown below:

Column 4, line 15, "he" should be --the--.

Column 4, line 29, "pases" should be --passes--.

Signed and Sealed this

*Thirteenth* Day of *April 1982*

[SEAL]

*Attest:*

GERALD J. MOSSINGHOFF

*Attesting Officer*

*Commissioner of Patents and Trademarks*